United States Patent [19]

Lampman

[11] Patent Number: 4,905,323

[45] Date of Patent: Mar. 6, 1990

[54] DISPOSABLE UNDERGARMENT

[76] Inventor: Jennifra Lampman, 2298 Cork Oak St., Sarasota, Fla. 34232

[21] Appl. No.: 293,206

[22] Filed: Jan. 4, 1989

[51] Int. Cl.[4] ..... A41B 9/00

[52] U.S. Cl. ..... 2/402; 2/406; 2/46; 604/385.2

[58] Field of Search ..... 2/46, 76, 402, 406, 2/338; 450/106, 153; 604/385.2

[56] References Cited

U.S. PATENT DOCUMENTS

| | | | |
|---|---|---|---|
| 1,959,282 | 5/1934 | Bade | 604/385.2 X |
| 1,998,140 | 4/1935 | Loew | 2/406 |
| 2,018,782 | 10/1935 | Gephart | 2/238 |
| 2,206,412 | 7/1940 | Levy | 2/406 |
| 2,408,723 | 8/1946 | Arpin et al. | 2/238 |
| 2,419,867 | 4/1947 | Woodman | 2/238 |
| 2,854,670 | 10/1958 | Naccash | 2/76 X |
| 2,891,545 | 6/1959 | Teague | 2/406 X |
| 2,951,481 | 9/1960 | Gordon | 128/284 |
| 3,094,990 | 6/1963 | Neilson | 450/106 |
| 3,594,820 | 7/1971 | McCurry | 2/402 |
| 3,774,241 | 11/1973 | Zerkle | 2/67 |
| 4,121,305 | 10/1978 | Kolker | 2/406 |
| 4,315,508 | 11/1980 | Bolick | 604/385.2 X |
| 4,505,706 | 3/1985 | Erpicum et al. | 604/389 |
| 4,553,550 | 11/1985 | Hattori | 128/505 |
| 4,630,320 | 12/1986 | Van Gompel | 2/406 |
| 4,639,949 | 2/1987 | Ales et al. | 2/402 X |
| 4,698,855 | 10/1987 | Hicks | 2/402 |
| 4,771,483 | 9/1988 | Hooreman et al. | 2/402 X |
| 4,808,176 | 2/1989 | Kielpikowski | 604/385.2 |

FOREIGN PATENT DOCUMENTS

| | | | |
|---|---|---|---|
| 475608 | 7/1951 | Canada | 2/46 |
| 1198902 | 7/1970 | United Kingdom | 2/402 |

*Primary Examiner*—Werner H. Schroeder
*Assistant Examiner*—Jeanette E. Chapman
*Attorney, Agent, or Firm*—Charles J. Prescott

[57] ABSTRACT

A disposable protective lower undergarment intended for use primiarly by women while trying on clothing such as bathing suits and the like at a store. The invention is structured to fit around, and be held to prevent, the woman's crotch area from coming into contact with the clothing being tried when conventional lower undergarments are removed. Several embodiments are disclosed; however, a very thin polypropylene strip connected by heat sealing the looped ends of this material around a thin endless elastic band is preferred.

7 Claims, 1 Drawing Sheet

Fig. 1
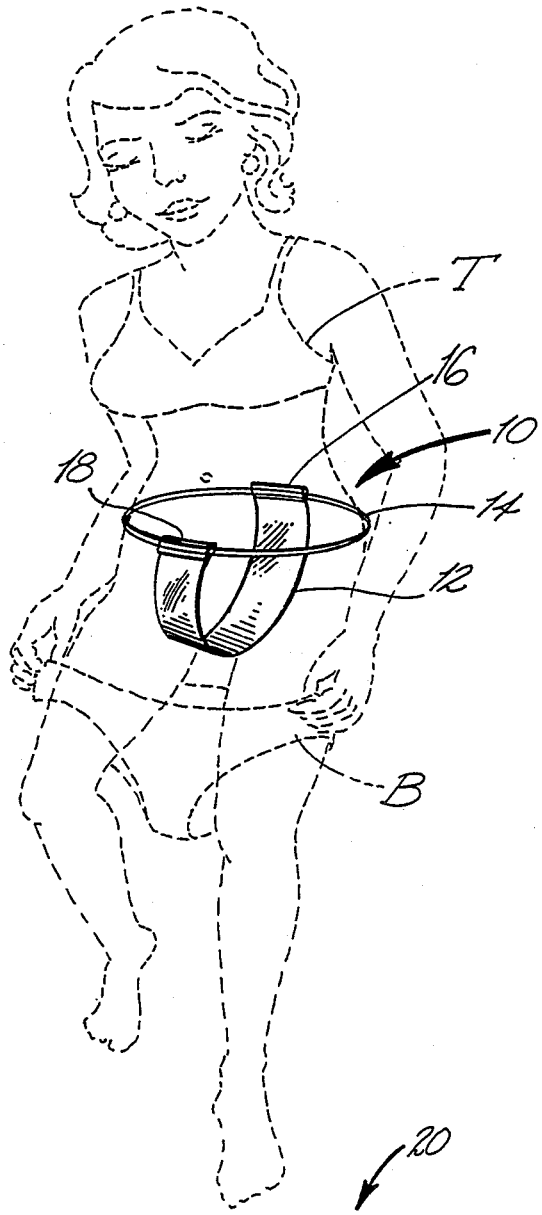
Fig. 3
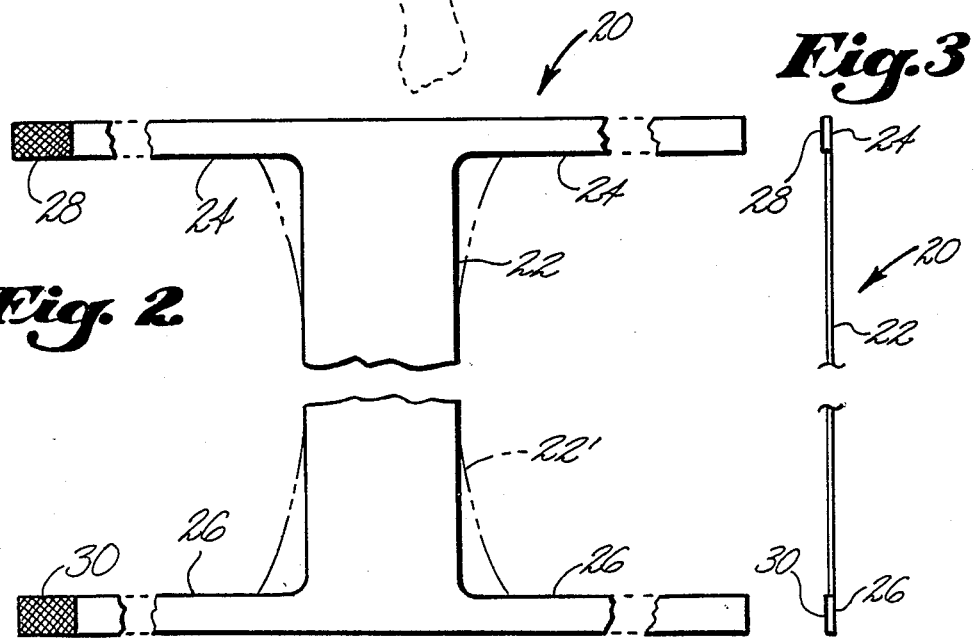
Fig. 2

DISPOSABLE UNDERGARMENT

BACKGROUND OF THE INVENTION

The present invention relates generally to a disposable undergarment, and more particularly to a very inexpensive disposable lower undergarment for use by women while trying on clothing.

Most women prefer to try on and fit certain types of clothing at retail stores having previously removed their conventional lower undergarment. However, presently applicant is unaware of any local, state or Federal law which requires prospective customers to wear a protective undergarment of any sort so as to avoid unsanitary contact with the new garment being tried on if it is not purchased by that individual. Therefore, because items of clothing such as bathing suits are, indeed generally relatively tight fitting, removal of conventional undergarments during trial fitting is desirable.

Although applicant is unaware of any convenient, economical fully substitute devices for use during clothes trying at clothing stores, applicant is aware of a number of inventions for use in conjunction with undergarments generally. One such invention is disclosed in U.S. Pat. No. 3,315,677 to Tyrrell which teaches a disposable shield having transfer tape to facilitate attachment to the crotch area of conventional undergarments. Another device is disclosed in U.S. Pat. No. 3,397,697 to Rickard which teaches a disposable sanitary shield for undergarments adapted to be releasably attachable around the crotch of undergarments. The garment shield disclosed in U.S. Pat. No. 4,059,114 to Richards is, likewise, directed to a disposable shield connectable to the crotch area of conventional undergarments for protection and every day feminine hygiene.

Two additional U.S. patents are known to applicant which are each generally directed to an entire disposable undergarment. However, in these U.S. Pat. Nos. 4,500,316 to Damico and 4,674,135 to Greene, structures are disclosed which are significantly dissimilar to that of the present invention.

The present invention is directed to an extremely inexpensive, light-weight, disposable undergarment which replaces the protective features of conventional undergarments and which is virtually unobtrusive to the fitting process of tight-fitting clothing such as swim suits. Because of its light weight structure and construction, women are certain to find its use completely unobjectionable so as to insure the sanitary condition of new clothing which is tried on and not purchased.

BRIEF SUMMARY OF THE INVENTION

This invention is directed to a disposable protective lower undergarment intended for use primarily by women while trying on clothing such as bathing suits and the like at a store. The invention is structured to fit around, and be held to prevent, the woman's crotch area from coming into contact with the clothing being tried when conventional lower undergarments are removed. Several embodiments are disclosed; however, a very thin polypropylene strip connected by heat sealing the looped ends of this material around a thin endless elastic band is preferred.

It is therefore an object of this invention to provide a disposable, light weight and inexpensive lower undergarment which may be worn, particularly by women, in place of a conventional undergarment in an unobtrusive manner while, nonetheless preventing contact between the woman's crotch area and that of the clothing being tried for size and appearance.

It is another object of this invention to provide a disposable, light-weight and inexpensive lower undergarment which may be worn in place of a conventional undergarment to prevent transfer of infectious bacteria or virus between the garment being tried on and the customer, particularly by women, trying on and fitting new clothing.

In accordance with this and other objects which will become apparent hereinafter, the instant invention will now be described with reference to the accompanying drawings in which:

BRIEF DESCRIPTION OF THE DRAWINGS

FIG. 1 is a pictorial view of the preferred embodiment of the invention in place for use on a woman trying on a bathing suit shown in phantom.

FIG. 2 is a top plan view of another embodiment of the invention with a further variation thereof shown in phantom.

FIG. 3 is a right side elevation view of the embodiment of the invention shown in FIG. 2.

DETAILED DESCRIPTION OF THE INVENTION

Referring now to the drawings, and particularly to FIG. 1, the preferred embodiment of the invention is shown generally at numeral 10 in its in-use configuration around a woman shown in phantom trying on clothing. The invention is particularly adaptable for use when women are trying on clothing such as tight-fitting bathing suits which include a top portion T and a bottom portion B.

During such fitting procedures, because the bottom portion B of clothing such as swimming suits are relatively tight-fitting and are normally worn without any additional undergarments, women prefer to try on these new clothing likewise without having any undergarment in place. The preferred embodiment of the invention 10 (and the invention in any of its other embodiments) is intended to replace conventional undergarments to protect and prevent the woman's crotch area from coming into contact with the bottoms of clothing B being tried on. The procedure of using the present invention appears necessary because women typically try on a significantly larger number of new clothing than the actually purchase.

To achieve its unobtrusiveness and non-projecting structural features while being worn as a protective undergarment during this trying on and fitting process, the preferred embodiment of the present invention 10 includes a strip of very thin polypropylene 12 which is fabricated of transparent polypropylene having a thickness of about 1 mil. or 0.001". This thickness of polypropylene is desirable because, in the first instance, it is of sufficient thickness and consistency so as to achieve the protective features desirable in the invention. Further, this very thin polypropylene is compliant so as to conform in flexibility and pliability to the contours of the woman's crotch area and, further to be held in position thusly without causing any visible protrusion beneath virtually the thinnest and tightest fitting of bathing suits being tried. Of course, thin polypropylene or the like, having the above-described characteristics, may be substituted.

To hold the polypropylene strip 12 in place, an endless elastic band 14 is also provided. This elastic band 14 is preferably fabricated of very thin diameter elastic cord such as "elastic thread" having a diameter of about 0.020" and a composition of 62% nylon/38% rubber. Thus formed in a continuous band as by knotting or heat sealing the ends of a length of such material together, having an elasticity stretch ratio of approximately 2 to 4, the elastic band 14 will fit virtually all sizes of womens' waists.

Each end of the polypropylene cover 12 is looped back on itself at 16 and 18 to surround the elastic waistband 14 and then be heat sealed transversely to effect permanent attachment therebetween. In this arrangement, the sealed loops 16 and 18 are slidably positionable around the waistband 14 so as to further facilitate the comfortable positioning of the invention 10 in temporary position during clothing fitting and trying.

The length and width of the polypropylene cover 12 is sufficient to insure adequate coverage of virtually all sizes of womens' crotch areas so as to be universal in a fashion similar to that of the very lightweight and elastic waistband.

Referring now to FIGS. 2 and 3, an alternate embodiment of the invention is shown generally at numeral 20 formed of an integral sheet of very thin polypropylene in the thickness range of about 1 mil. The integral sheet 20 includes an elongated generally rectangular main portion 22 which is of a size and length similar to that previously described as numeral 12. This main portion 22 is also intended to be sufficiently pliable and flexible so as to comfortably and unobtrusively cover the woman's crotch area during clothing try-on.

Extending laterally in both directions from each end of the main portion 22 are a pair of opposing tie straps 24 and 26. These tie straps 24 and 26 are of a sufficient length so as to conveniently surround the woman's waist area after the main portion 22 has been positioned to cover the woman's crotch area and snugly tieable in place for use as a disposable protective undergarment as previously described. Because the polypropylene is extremely thin and flexible, after the device 20 is used, the tie straps 24 may be easily torn apart for disposal of the entire device 20.

Two further alternative features are shown in FIGS. 2 and 3. The first includes an adhesive patch at 28 and 30 which is applied to the distal end surface of one portion of each tie strap 24 and 26. This adhesive 28 and 30 is provided to replace the need for knotting the tie straps 24 and 26 to one another, the adhesive area 28 or 30 overlapping the corresponding the mating tie strap 24 or 26 respectively so as to releasably adhere the two halves of the tie straps 24 and 26 together in place snugly around the woman's waist area. A further variation envisioned by applicant would be to provide adhesive onto each end of straps 24 and 26 and to shorten the straps somewhat to allow the adhesive areas to only reach and releasably attach directly to the skin surface around the waist area.

For simplicity, the preferred configuration of the main portion 22 is rectangular as shown in solid. However, it may be desirable, when manufacturing the invention from a die-cut integral sheet, to narrow the midregion somewhat to further enhance the pliable conforming of the main portion 22' between the woman's legs and fully against the entire crotch area.

Although all embodiments of the invention have been described as being fabricated from very thin polypropylene, it should be understood that other very thin flexible sheet materials which are similarly pliably conformable for this purpose may be substituted therefore. Such substitute materials within the scope of this invention might include very thin fibrous sheet material such as that presently utilized to fabricate disposable paper clothing.

While the instant invention has been shown and described herein in what is conceived to be the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A disposable protective lower undergarment for use by women while trying on new clothing such as swim suits and the like after removal of conventional lower undergarments comprising:

a cover formed of an elongated rectangular length of very thin, flexible nonporous sheet material sized to extend over only a woman's crotch area;

a single endless waistband formed of very thin elastic cord;

said cover slidably connected at each end directly to said waistband by heat sealing a loop formed at each end of said cover around said waistband;

said waistband sized to elastically surround the woman's waist and to support said cover against the woman's crotch area while trying on clothing; and said cover and said waistband structured and sized to be unobtrusive and non-projecting beneath tight fitting clothing being tried.

2. A lower undergarment as set forth in claim 1, wherein: said cover is constructed of a strip of polypropylene.

3. A lower undergarment as set forth in claim 2, wherein: said polypropylene is about one mil. in thickness.

4. A lower undergarment as set forth in claim 3, wherein: said waistband is constructed of elastic thread.

5. A disposable lower undergarment for women while trying on new clothing such as swim suits and the like after removal of conventional lower undergarments comprising:

an integral sheet of very thin, flexible nonporous material having an elongated rectangular main portion and laterally extending tie straps extending in both directions from each end of said main portion;

said main portion sized to cover only a woman's crotch area;

said tie straps sized to tieably cooperate to snugly surround the woman's waist and to support said main portion against the woman's crotch area while trying on clothing;

said cover and said waistband structured and sized to be unobtrusive and non-projecting beneath tight fitting clothing being tried; and an adhesive applied to a distal end of at least one portion of each said tie straps;

said tie straps sized so as to overlap one another to facilitate said adhesive releasably connecting mating said tie straps against one another when in place around the woman's waist.

6. A disposable lower undergarment as set forth in claim 5, wherein:

said integral sheet is constructed of a strip of polypropylene.

7. A disposable lower undergarment as set forth in claim 6, wherein:

said polypropylene is about one mil. in thickness.

* * * * *